US005857369A

United States Patent [19]

Fang

[11] Patent Number: 5,857,369

[45] Date of Patent: Jan. 12, 1999

[54] METHOD FOR FABRICATING LIGHT WEIGHT PIPE CONNECTORS

[76] Inventor: Jui-Hwa Fang, 2F, No. 2, Lane 15, Jidy-Chiung St., Lo-Choy Shiang Taipei Hsien, Taiwan

[21] Appl. No.: 759,513

[22] Filed: Dec. 4, 1996

[51] Int. Cl.[6] ..... B21D 19/04

[52] U.S. Cl. ..... 72/105; 72/11; 72/305

[58] Field of Search ..... 72/80, 102, 105, 72/106, 110, 111, 305

[56] References Cited

U.S. PATENT DOCUMENTS

| | | | |
|---|---|---|---|
| 333,904 | 1/1886 | Voight | 72/105 |
| 3,754,424 | 8/1973 | Costanzo | 72/105 |
| 3,937,051 | 2/1976 | Banks | 72/105 |
| 4,711,110 | 12/1987 | Castricum | 72/105 |
| 5,570,603 | 11/1996 | Chatterley et al. | 72/105 |

*Primary Examiner*—David Jones

*Attorney, Agent, or Firm*—W. Wayne Liauh

[57] ABSTRACT

A lightweight pipe connector fabrication method for rolling clamping groove for each end of metal plate made semi-finished pipe connector of various forms by using a specified groove rolling machine, the groove rolling machine including a rolling unit and a positioning unit; the rolling unit having a rolling roll permitted to be received into the opening end of the pipe connector, an impression roll moved relative to the rolling roll to impress the pipe connector against the rolling roll, the positioning unit having a rack moved horizontally toward the rolling unit, an operation saddle supported on the rack and moved vertically, an upright frame raised from the operation saddle, a vertical turning table disposed on the upright frame, a 4-directional fixture means mounted on the turning table and controlled for fixing and centering the pipe connector, permitting it to be moved to receive the rolling roll into the opening end of the pipe connector and rolled by the rolling roll and the impression roll.

1 Claim, 7 Drawing Sheets

METHOD FOR FABRICATING LIGHT WEIGHT PIPE CONNECTORS

BACKGROUND OF THE INVENTION

The present invention relates to a method for making clamping grooves around each end of lightweight pipe connectors (fittings), and relates more particularly to the method rolling grooves for a semi-finished pipe connector made of metal plate after the common steps have been taken by using a special groove rooling machine which comprises a tolling unit and a positioning unit for mass fablication.

Regular pipe connectors (fittings) are commonly made of metal by casting. The wall of a pipe connector made by casting has a certain thickness. During installation, a tapered pipe thread or an annular groove must be made at each end by cutting. However, because a pipe connector made by casting is heavy, it is not suitable for all purposes. In some cases, lightweight pipe connectors shall be used. Regular lightweight pipe connectors are commonly made by processing a metal plate into a tube, then cutting the tube thus obtained to the desired size and then processing it into a pipe connector of desired shape by hydraulic extruding and welding. Because a pipe connector made according to this method has a thin wall thickness, it cannot be processed with a tapered thread even an annular groove by this case, a rolling machine of common use may be used to make the end of the pipe connector with an annular groove. However, the working piece fixture of a common use rolling machine is not suitable for various shap of pipe connector for example an elbow or a Y-shaped connector, further more, it is difficult for centering the working piece in position.

SUMMARY OF THE INVENTION

It is one object of the present invention to provide a pipe connector fabrication method which produces lightweight pipe connectors efficiently. It is another object of the present invention to provide a pipe connector fabrication method which is practical to roll the ends of any shape of pipe connector with clamping grooves. According to the present invention, the pipe connector fabrication method after the common steps of i) preparing a metal plate, ii) processing the metal plate into a tube, iii) cutting the tube thus obtained to the desired size, and then processing it into a pipe connector of desired shape by hydraulic extruding and welding, and then by using a groove rolling machine to roll a groove, around each end of the pipe connector thus obtained. The groove rolling machine comprises a rolling unit and a positioning unit, which the rolling unit has a rolling roll to be adapted into the pocket of the pipe connector, an impression roll moved relative to the rolling roll to impress the pipe connector against the rolling roll, while the positioning unit has a rack moved horizontally toward the rolling unit, an operation saddle supported on the rack and moved vertically, an upright frame raised from the operation saddle, a vertical turning table mounted on the upright frame toward the rolling unit, a 4-directional fixture means mounted on the vertical turning table and spaced a certain distance away from the turning table to maintain enough space for fixing any kind of various shaped pipe connectors thereon, and permitting the positioning unit to be moved to adapt the rolling roll being received in the opening end of the pipe connector and rolled by it.

DETAILED DESCRIPTION OF THE PREFERRED EMBODIMENT

FIGS. 4A to 4G show different forms of pipe connectors (fittings) made according to the present invention, including Y-shaped pipe connectors (4A, 4B), 90° elbow (4C), 45° elbow (4D), T-connector (4E), crossed connector (4F), and pipe cap (4G).

Figure 1:
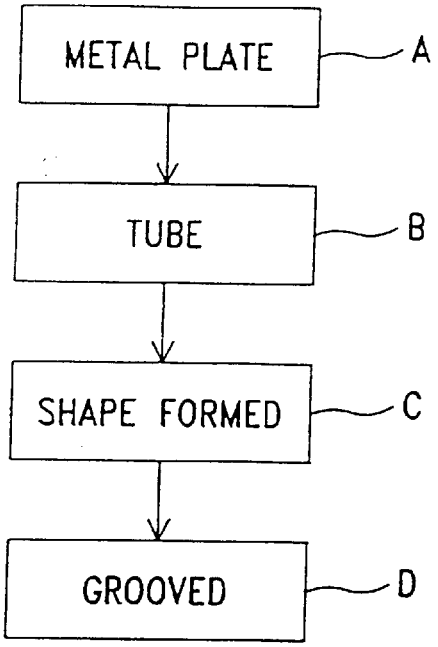
FIG. 1 is a flow chart showing the fabrication of a pipe connector according to the present invention.
Figure 2:
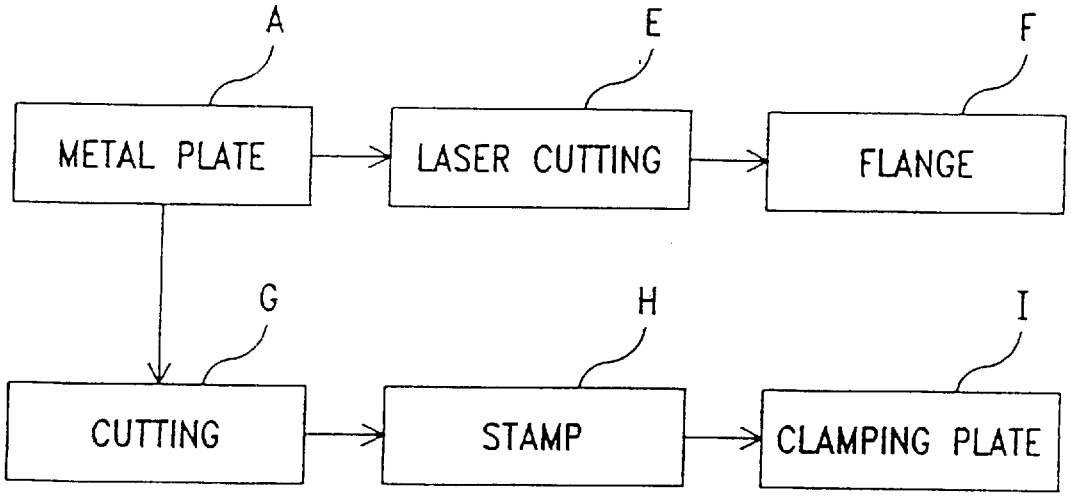
FIG. 2 is a flow chart showing the fabrication of a connector fixture according to the present invention.
Figure 3:
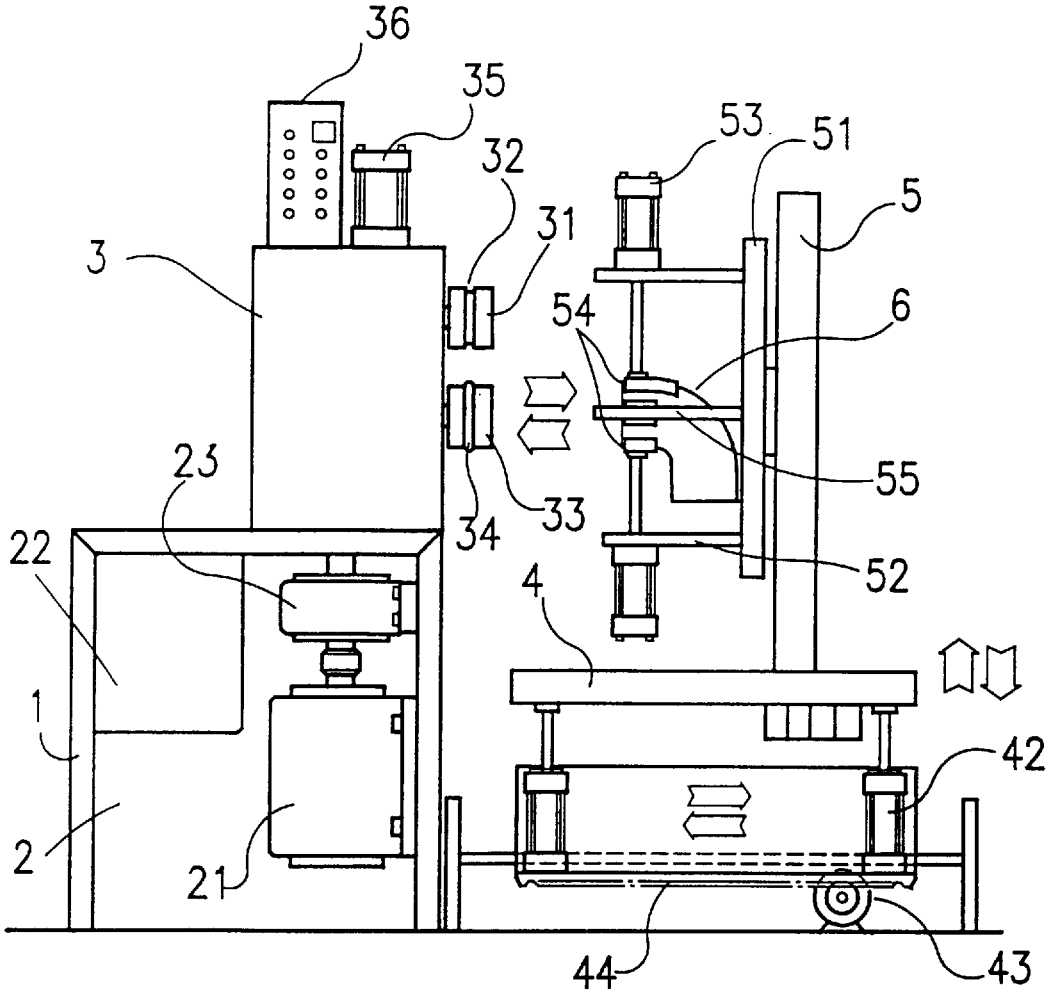
FIG. 3 shows the structure of a groove milling machine according to the present invention.
Figure 4A:
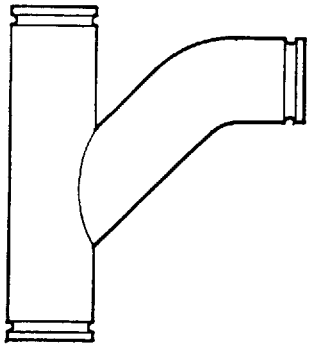
FIG. 4 shows different forms of pipe connectors to be fablicated according to the present invention.
Figure 4B:
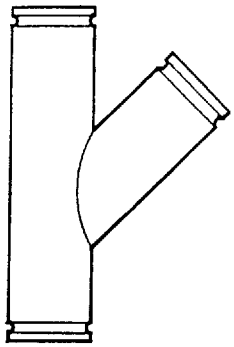
Figure 4C:
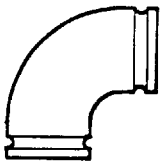
Figure 4D:
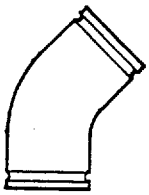
Figure 4E:
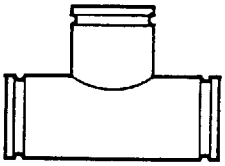
Figure 4F:
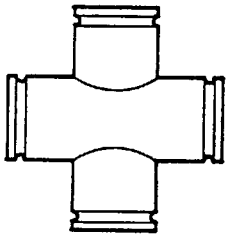
Figure 4G:
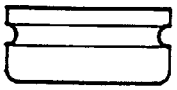
Figure 5:
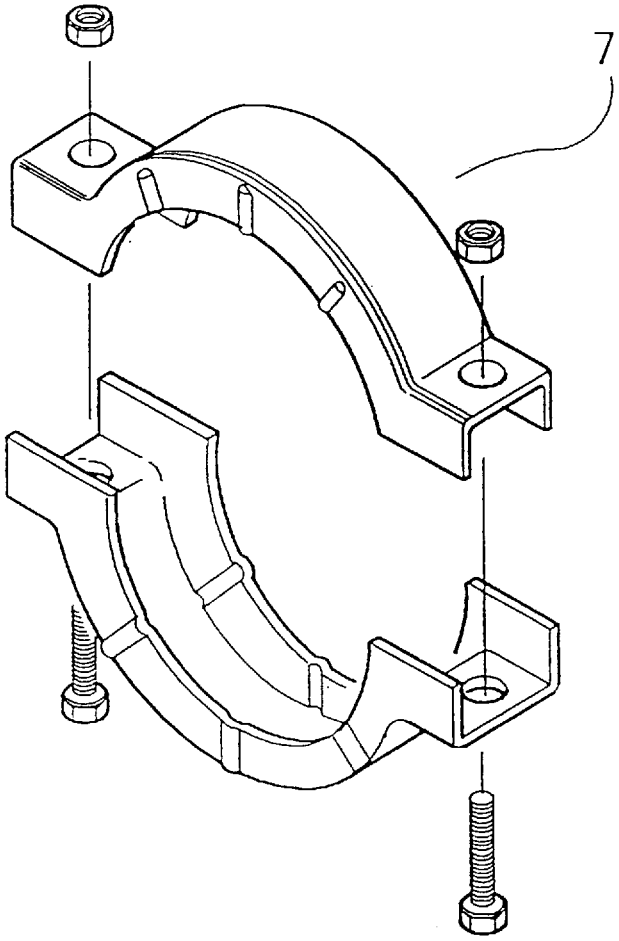
FIG. 5 is an exploded view of a clamping plate type connector fixture to be used for the present invention.
Figure 6:
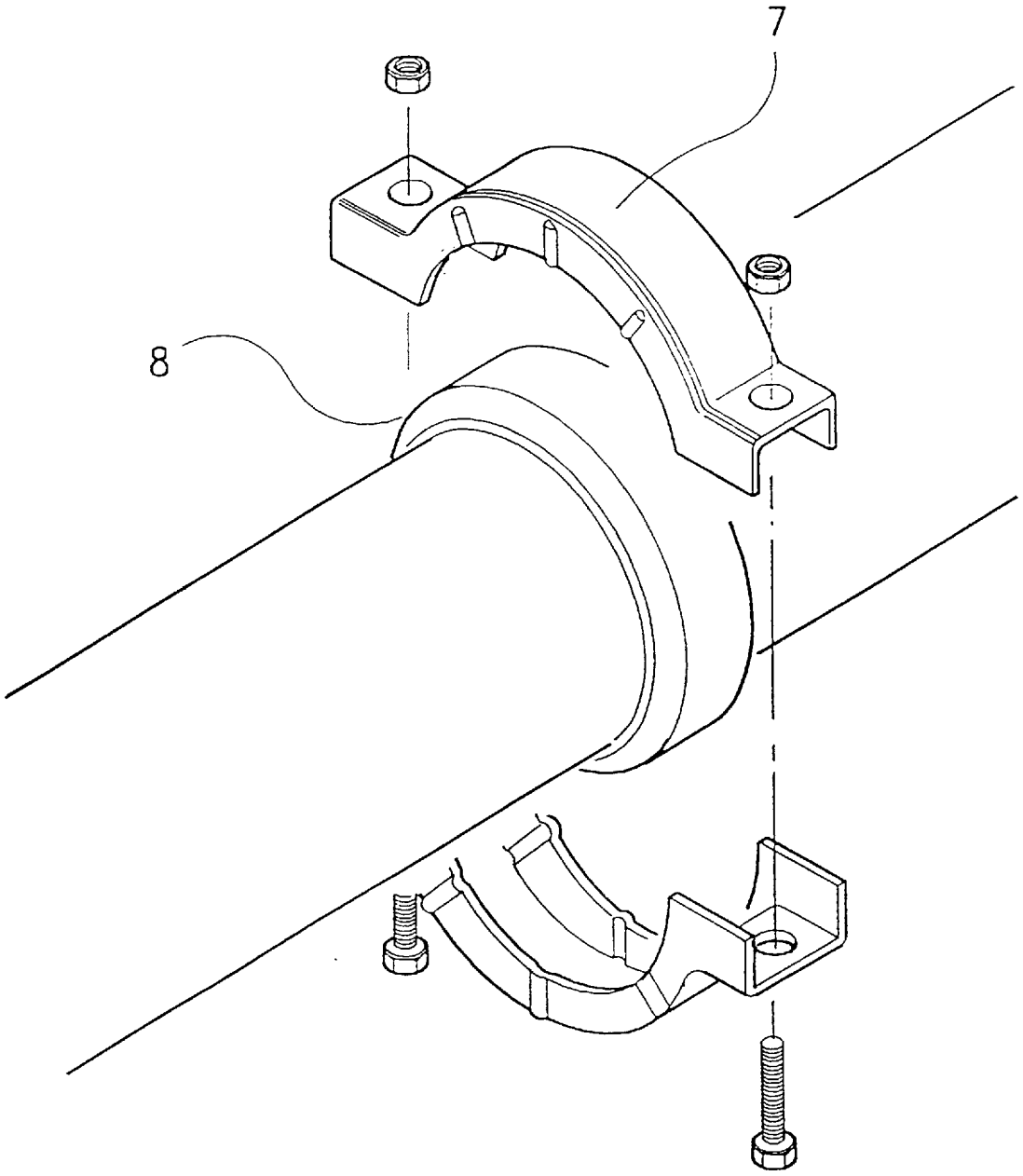
FIG. 6 shows an application example of the clamping plate type connector fixture for the present invention.
Figure 7:
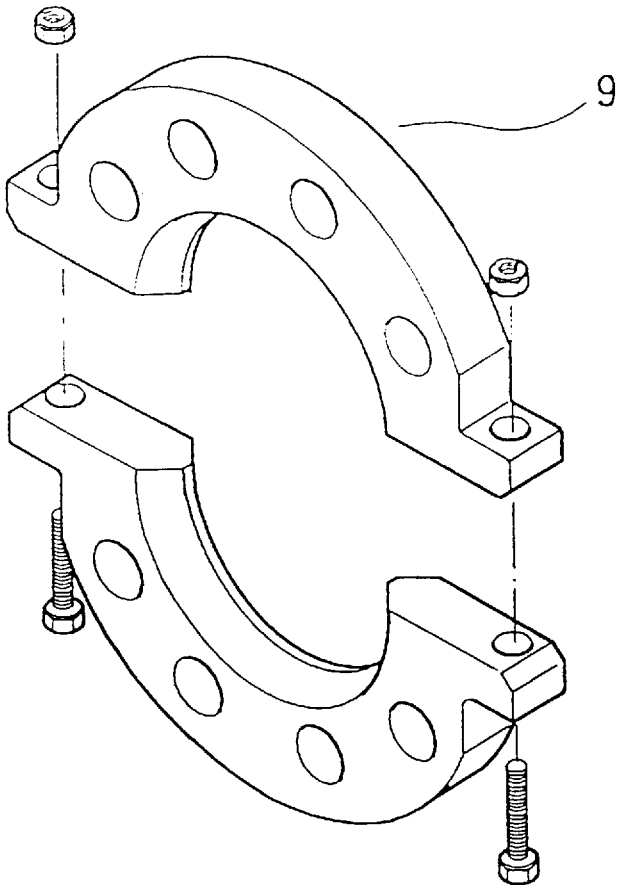
FIG. 7 is an exploded view of a flange type connector fixture to be used for the present invention; and, FIG. 8 shows an application example of the flange type connector fixture for the present invention.
Figure 8:
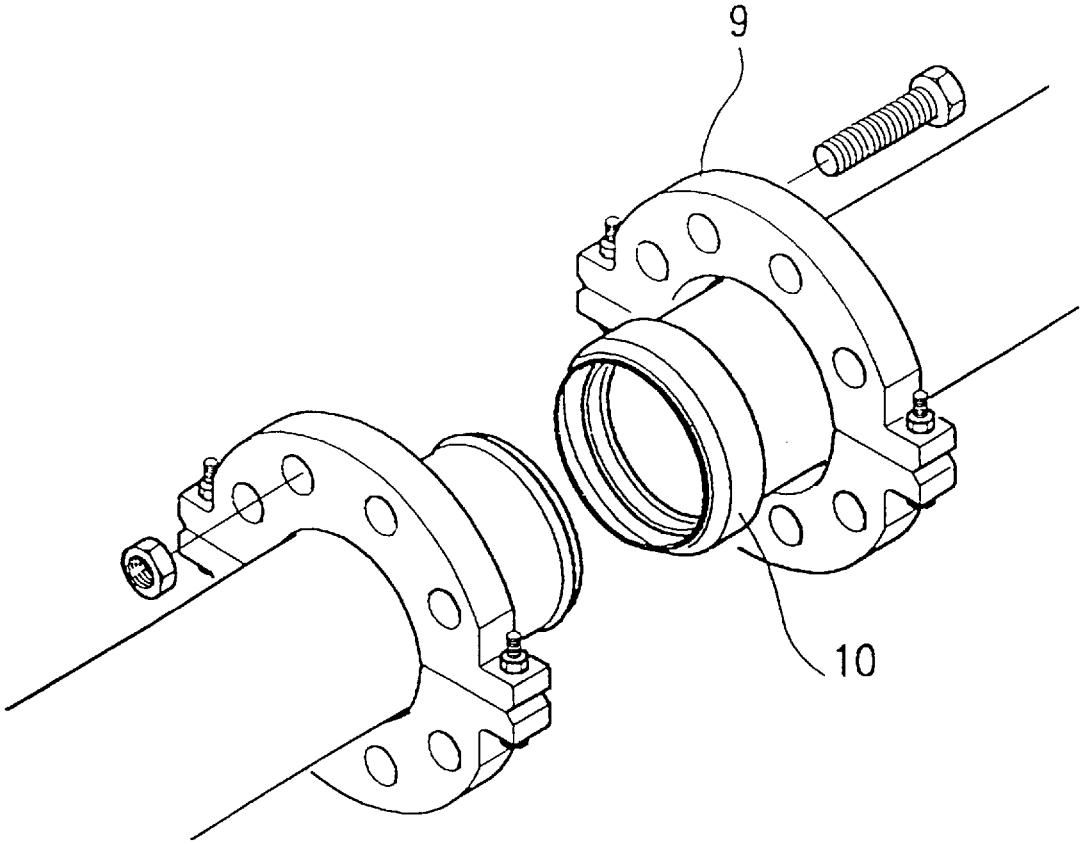

Referring to FIG. 3, the groove rolling machine comprises a rolling unit and a positioning unit. The rolling unit comprises a machine base 1, a power drive 2 mounted in the machine base 1, and a rolling mechanism 3 mounted on the machine base 1 at the top and coupled to the power drive 2. The power drive 2 comprises an air accumulator 22, a motor 21, and a reduction gear 23. The air accumulator 22 provides compressed air to the air cylinders of the rolling unit and the air cylinders of the positioning unit. The rolling mechanism 3 comprises a lateral rolling roll 31 turned by the motor 21 through the reduction gear 23 and having an annular groove 32 around the periphery, an impression cam roll 33 disposed parallely above the rolling roll 31 and having a convex flank 34 around the periphery corresponding to the groove 32 of the rolling roll 31, an air cylinder 35 connected to the air accumulator 22 of the power drive 2 and controlled by a control device 36 to move the impression cam roll 33 up and down relative to the rolling roll 31. The aforesaid positioning unit comprises a rack 44 supported on roller 43 and moved forwards and backwards toward the rolling unit, an operation saddle 4 supported on the rack 44, a plurality of air cylinders 42 respectively connected to the air accumulator 22 of the power drive 2 and controlled to lift the operation saddle 4, an upright frame 5 raised from the operation saddle 4, a vertical turning table 51 disposed to the upright frame 5 at one side and facing the rolling mechanism 3, a 4-directional fixture means including two opposite horizontal supports 52 perpendicularly extended from the fly wheel 51, two air cylinders 53 respectively mounted on the horizontal supports 52 and connected to the air accumulator 22 of the power drive 2, two vertical clamping plates 54 respectively fastened to the pistons rods (not labled) of the air cylinders 53 and moved relative to each other to clamp the workpiece (for example, an elbow) 6 vertically, and two opposite horizontal clamping plates 55 operated by two horizontal air cylinders (not shown) respectively as well as the vertical clamping plates 54 to clamp the workpiece 6 horizontally. When in use, the clamping plates 54 and 55 are adjusted to clamp the workpiece 6, permitting the center line of the workpiece 6 to be aligned with the center line, of the turning table 51 and parallel to the center line of the rolling roll 31, and then the operation saddle 4 is lifted to the desired height, and then the rack 44 is moved forwards, permitting the rolling roll 31 to be receive into the workpiece 6, and then the impression roll 33 is moved toward the workpiece 6 and the rolling roll 31, thereby causing the convex flank 34 of the impression roll 33 to roll the end of the workpiece 6 against the groove 32 of the rolling roll 31.

Referring to FIGS. from 5 to 8, by means of the groove at the end of the pipe connectors the pipe connector can be conveniently fastened to a pipe or the like with a sealing ring 8, 10 between the flanges 9 or the clamping plates 7.

What the invention claimed is:

1. A method for fabricating pipe connectors having a rolling clamping groove, said method comprising the steps of:

(a) providing a pipe connector-having at least an open end;

(b) providing a groove rolling machine said groove rolling machine comprising:

(i) a rolling unit and a positioning unit;

(ii) a rolling roll and a movable impressing roll provided in said rolling unit, wherein said rolling roll has a protruded ring around its periphery for receiving said pipe connector so as to form a groove of predetermined dimension, and said impression roll has a ring-shaped groove and is movable relative to said rolling roll so as to impress said pipe connector against said rolling roll;

(iii) said positioning unit comprising a horizontally movable rack having a vertically movable operation table supported on said rack, an upright frame raised from said operation table, a vertically mounted tuning table on said upright frame, and a 4-directional holding means for holding said pipe connector, said 4-directional holding means comprising a pair of horizontal clamping plates and a pair of vertical clamping plates; and (c) operating said 4-directional holding means to hold said pipe connector so that it can be received by said rolling roll;

(d) operating said positioning unit to cause said pipe connector to be received by said rolling roll; and (e) moving said impression roll toward said rolling roll and rolling said rolling roll so as to impress said pipe connector and form a groove on said pipe connector.

* * * * *